US007015647B2

(12) United States Patent
Maede et al.

(10) Patent No.: US 7,015,647 B2
(45) Date of Patent: Mar. 21, 2006

(54) ORGANIC EL ELEMENT DRIVE CIRCUIT AND ORGANIC EL DISPLAY DEVICE USING THE SAME DRIVE CIRCUIT

(75) Inventors: Jun Maede, Kyoto (JP); Shinichi Abe, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 34 days.

(21) Appl. No.: 10/868,900

(22) Filed: Jun. 17, 2004

(65) Prior Publication Data

US 2004/0263087 A1 Dec. 30, 2004

(30) Foreign Application Priority Data

Jun. 25, 2003 (JP) ..... 2003-180624

(51) Int. Cl.
*G09G 3/10* (2006.01)

(52) U.S. Cl. ..... 315/169.3; 315/169.4; 315/169.2; 345/76

(58) Field of Classification Search ..... None
See application file for complete search history.

(56) References Cited

U.S. PATENT DOCUMENTS 5,990,629 A * 11/1999 Yamada et al. ..... 315/169.3
6,756,738 B1 * 6/2004 Maede et al. ..... 315/169.1
2002/0014849 A1 * 2/2002 Tsujikawa et al. ..... 315/169.1
2003/0184236 A1 * 10/2003 Maede et al. ..... 315/169.1

FOREIGN PATENT DOCUMENTS

JP 9-232074 9/1997
JP 2001-143867 5/2001
JP 2003-308043 10/2003

* cited by examiner

*Primary Examiner*—Binh Van Ho
(74) *Attorney, Agent, or Firm*—Mattingly, Stanger, Malur & Brundidge, P.C.

(57) ABSTRACT

An organic EL element drive circuit comprises a current mirror circuit including an input side transistor supplied with a predetermined current and a plurality of output side transistors provided correspondingly to terminal pins of an organic EL display panel, for obtaining drive currents to be supplied to the respective terminal pins, a switch circuit connected in parallel to or in series with the input side transistor of the current mirror circuit, a memory for storing display data indicative of luminous intensities of the organic EL elements driven through the terminal pins and a control circuit for ON/OFF controlling the switch circuit to cut predetermined current supplied to the input side transistor when the display data stored in the memory for one horizontal display line or for a part of the one horizontal display line indicates that the organic EL elements are not to be driven.

18 Claims, 4 Drawing Sheets

ORGANIC EL ELEMENT DRIVE CIRCUIT AND ORGANIC EL DISPLAY DEVICE USING THE SAME DRIVE CIRCUIT

BACKGROUND OF THE INVENTION

1. Field of the Invention

The present invention relates to an EL (electro luminescent) element drive circuit and an organic EL display device using the same drive circuit. In particular, the present invention relates to an improvement of an organic EL element drive circuit having a current drive circuit for current-driving organic EL elements connected to a column line, which is an anode side drive line of the organic EL elements of an organic EL display panel through terminal pins thereof and a small size additional circuit for improving power consumption of the current drive circuit, circuit size of which is small enough to restrict increase of the organic EL element drive circuit when the current drive circuit and the additional circuit are formed in an IC chip.

2. Description of the Prior Art

An organic EL display panel of an organic EL display device, which is mounted on a portable telephone set, a PHS, a DVD player or a PDA (personal digital assistance) and includes 396 (132×3) terminal pins for column lines and 162 terminal pins for row lines, has been proposed and the number of column lines and the number of row lines of such organic EL display panel tend to be further increased.

An output stage of a current drive circuit of such organic EL display panel includes an output -circuit constructed with, for example, current-mirror circuits, which are provided correspondingly to respective terminal pins of the panel, regardless of the type of drive current, the passive matrix type or the active matrix type.

Incidentally, JPH9-232074A discloses a drive circuit for organic EL elements, in which the organic EL elements arranged in a matrix are current-driven and a terminal voltage of each organic EL element is reset by grounding an anode and a cathode of the organic EL element Further, JP2001-143867A discloses a technique with which power consumption of an organic EL display device is reduced by current-driving organic EL elements with using DC—DC converters.

Incidentally, in order to emphasize a display of telephone numbers, etc., on a portable telephone set, etc. it is usual to limit a display area for such information to a center portion of a display screen and to surround the display area by a black frame or another color background. Further, a background of the display screen may be displayed by one of three primary colors, red (R), green (G) and blue (B) for purpose of some warning display.

In the case of the one color display or the black background, organic EL elements for only one color or all of the R, G and B display colors are not actuated.

In the case of the black background or the partial actuation of the organic EL elements, it may be considered that, in order to reduce power consumption, switch circuits for stopping operations of output stage current sources are provided correspondingly to respective terminal pins of an organic EL display panel as additional circuits. In such case, however, there are problems that such additional circuits may increase the circuit size of an organic EL drive circuit and that a control of such additional circuits may become complicated.

Therefore, it has been usual that, in the case of the black frame background or the case where organic EL elements for any one of R, G and B display colors are not actuated, display data for preventing drive currents of these organic EL elements from generating is set in drive stages of the organic EL element drive circuit and the power consumption is reduced by stopping the drive current supply from the output stage of the organic EL element drive circuit to the terminal pins of the organic EL panel. In such case, the drive stage in which the display data is set must be operated even during the black frame background or the non-actuation period of the organic EL elements and, therefore, power consumption of the output stage for the organic EL elements for one horizontal display line corresponding to one horizontal scan direction can not be neglected.

On the other hand, the number of driving terminal pins of an organic EL panel tends to increase according to high resolution request. According to this tendency, the number of output stages of the current drive circuit tends to be increased with increase of the number of the driving terminal pins. Therefore, the circuit size of the organic EL element drive circuit is increased, so that the power consumption of the organic EL element drive circuit is increased.

SUMMARY OF THE INVENTION

An object of the present invention is to provide an organic EL element drive circuit, which includes a current drive circuit and an additional circuit having small circuit size for reducing power consumption of the current drive circuit and can be formed in an IC chip without increasing the circuit size of the current drive circuit.

Another object of the present invention is to provide an organic EL display device having an organic EL drive circuit, which includes a current drive circuit and an additional circuit having small circuit size for reducing power consumption of the current drive circuit and can be formed in an IC chip without increasing the circuit size of the current drive circuit.

In order to achieve the above objects, an organic EL element drive circuit according to a first aspect of the present invention comprises a current mirror circuit including an input side transistor supplied with a predetermined current and a plurality of output side transistors provided correspondingly to terminal pins of an organic EL display panel, for obtaining currents to be supplied to the respective terminal pins, a switch circuit connected in parallel to or in series with the input side transistor of the current mirror circuit, a memory for storing display data indicative of luminous intensities of the organic EL elements driven through the terminal pins and a control circuit for turning the switch circuit ON or OFF to block the predetermined current supplied to the input side transistor when the display data in the memory for one horizontal display line or for a part of the one horizontal display line or a display data to be stored in the memory indicates that corresponding organic EL elements are not-to be actuated.

The organic EL element drive circuit according to a second aspect of the present invention further includes a reference current generator circuit for generating a reference current. The reference current generated by the reference current generator circuit is supplied to the input side transistor of the current mirror circuit directly or after a current value thereof is regulated and the switch circuit is provided between the reference current generator circuit and the input side transistor of the current mirror circuit.

According to the first aspect of the present invention, the switch circuit is connected in parallel to or in series with the input side transistor of the current mirror circuit, which is a current duplication/distribution circuit, having the parallel outputs at which the predetermined currents duplicated thereby and to be supplied to the respective terminal pins or reference currents on which the currents to be supplied to the respective terminal pins are generated. The switch circuit is turned ON or OFF to block the predetermined current supplied to the input side transistor of the current mirror circuit when the display data stored in the memory (for example, registers) of the terminal pins for one horizontal scan line or for a part of the one horizontal scan line indicates that the organic EL elements are not to be actuated. Thus, the switch circuit can stop the current supply to the input side transistor of the current mirror circuit and so no current is supplied to circuits subsequent to the current mirror circuit when the organic EL elements for one horizontal display line or for a part of the one horizontal display line*are not to be actuated. As a result, power consumed in the current mirror circuit and circuits subsequent thereto can be reduced.

In this case, it is possible to ON/OFF control the reference current generated in the input stage of the current drive circuit, which is preceding to a drive stage thereof, by means of the switch circuit. However, when the reference current, which is in micro-amperes order or smaller, is ON/OFF controlled, a start of the display operation is delayed and the quality of displayed image is degraded thereby. However, since such problem can be avoided in the current mirror circuit of the drive stage of the organic EL element drive circuit, which receives the display data, the image display is made at high speed even when the operation of the current mirror circuit is re-started.

According to the second aspect of the present invention, the reference current is cut in a stage preceding the input side transistor of the current mirror circuit by ON/OFF control of the switch circuit provided between the reference current generator circuit and the input side transistor of the current mirror circuit so that the input side transistor can not be driven. In such case, the reduction of power consumption can be realized although the start of the image display is slightly delayed compared with the case where the switch circuit is connected in parallel to or in series with the input side transistor of the current mirror circuit.

As a result, when the current drive circuit is formed as an IC, it is enough to provide at least one (three in the case of color display) switch circuit for the current mirror circuit for driving the organic EL elements for one horizontal display line or for a part of the one horizontal display line and to ON/OFF control the switch circuit. Therefore, the circuit size of the additional circuit provided for reducing power consumption is very small and the increase of the circuit size of the current drive circuit can be restricted. Thus, the power consumption of the organic EL element drive circuit can be reduced with minimum increase of the circuit size.

DETAILED DESCRIPTION OF THE PREFERRED EMBODIMENTS

Figure 1:
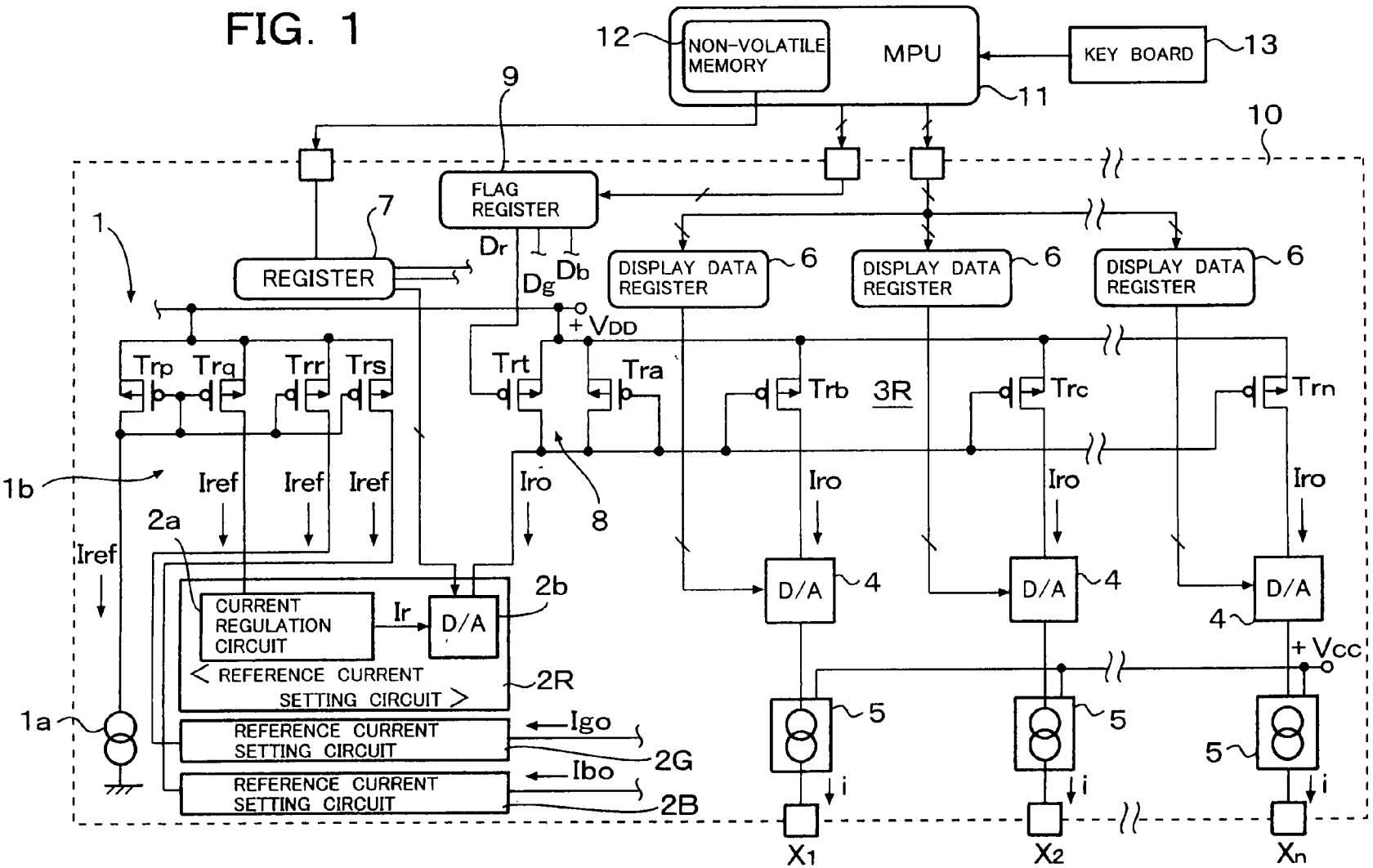
FIG. 1 is a block circuit diagram of a column driver of an organic EL panel including an organic EL element drive circuit according to an embodiment of the present invention, which is formed as an IC.

A column driver 10 shown in FIG. 1 is formed as an column IC chip functioning as an organic EL drive circuit of an organic EL panel.

The column driver 10 includes a reference current generator circuit 1, a reference current setting circuit 2R provided for R (red) display color, a reference current setting circuit 2G provided for G (green) display color and a reference current setting circuit 2B provided for B (blue) display color.

Each of the reference current setting circuits 2R, 2G and 2B includes a current regulation circuit 2*a* and a D/A converter circuit 2*b* of, for example, 4 bits. The reference current setting circuit 2*a* is responsive to a reference current Iref generated by the reference current generator circuit 1 to form a reference current corresponding to a display color assigned thereto.

That is, the reference current setting circuits 2*a* and the D/A converters 2*b* of the reference current setting circuits 2R, 2G and 2B generate reference drive currents Iro, Igo and Ibo corresponding to the respective R, G and B colors by respectively regulating the reference current Iref and the current mirror circuits as a current duplication/distribution circuits corresponding to the respective display colors are driven by the drive currents Iro, Igo and Ibo thus generated. Incidentally, a reference numeral 3R in FIG. 1 is the current mirror circuit for R display color. A plurality of output side transistors of the current mirror circuit for one of display colors R, G and B output the reference drive currents Iro, Igo or Ibo as a base current from which the drive currents supplied to said terminal pins are generated, to the output terminals corresponding to the terminal pins of the organic EL display panel.

Incidentally, since the current regulation circuits 2*a* and the D/A converter circuits 2*b* of the reference current setting circuits 2R, 2G and 2B have identical constructions, only the current regulation circuit 2*a* and the D/A converter circuit 2*b* of the reference current setting circuit 2R for R display color are shown in FIG. 1. Further, since the current mirror circuits connected to the reference current setting circuits 2R, 2G and 2B for respective R, G and B display colors also have identical constructions, only the current mirror circuit 3R connected to the reference current setting circuit 2R for R display color is shown in FIG. 1.

The reference current generator circuit 1 is composed of a constant current source 1*a* for generating the reference current Iref as a sink current and a current mirror circuit 1*b* provided on an upstream side of the constant current source 1*a*. The current mirror circuit 1*b* functions to distribute the reference current Iref to the reference current setting circuits 2R, 2G and 2B for respective R, G and B display colors and is composed of an input side P channel MOS transistor Trp connected to the constant current source 1*a* and three output side P channel MOS transistors Trq, Trr and Trs. Drains of the transistors Trq, Trr and Trs are connected to the reference current setting circuits 2R, 2G and 2B, respectively.

In the following description, the reference current setting circuit 2R for R color and the circuits subsequent thereto will be described mainly.

In response to the reference current Iref distributed from the drain of the transistor Trq of the reference current generator circuit 1 to the current value regulation circuit 2*a* of the reference current setting circuit 2R, the reference current setting circuit 2R generates an output current Ir having a first current value corresponding to R color. The current regulation of the current regulation circuit 2*a* is performed by cutting fuses away by laser trimming in a fabrication step of the IC. Alternatively, the regulation of current performed in the IC producing step may be performed by selecting contact wiring by masking.

The value of the output current Ir of the reference current setting circuit 2R is set to a suitable value for obtaining luminous intensity of R display color with which white balance is obtained together with luminous intensities of G and B colors. That is, the output current Ir is regulated such that it becomes a center value, which is a reference value or a design reference value used to roughly regulating variation of luminous intensity for R color, corresponding to the drive circuit variation for R color. Similar regulation is performed for respective G and B colors. By this regulation, the rough regulation for obtaining white balance is performed. A fine regulation of white balance is performed by the D/A converter circuits 2*b* as to be described later. Particularly, in order to roughly regulate the luminous intensities for all of R, G and B display colors, it is preferable that regulation references of them are on the design reference values for respective R, G and B colors.

The white balance regulation is performed by regulating luminous intensities of two of R, G and B display colors with using luminous intensity of the remaining display color as a reference. Therefore, in a case where variation of luminous intensities of R, G and B in one column driver as a product is small, the output current of one of R, G and B display colors becomes a center current value (the reference value or the design reference value for the rough regulation of luminous variation). In such case, the regulation of current values for the other two display colors can be done in a later step on the basis of the data setting in the D/A converter circuits 2*b* of the corresponding reference current setting circuits.

The output current Ir of the current regulator circuit 2*a* is supplied to the 4-bit D/A converter circuit 2*b*. The 4-bit D/A converter circuit 2*b* is responsive to a regulation data for R color supplied from an MPU 11 through a register 7 to finely regulate the output current Ir and generates a finely regulated current Iro as a second current.

The 4-bit D/A converter circuit 2*b* is, for example, a current switching D/A converter constructed with a current mirror circuit. The output current Ir is supplied to an input side transistor of the current mirror circuit and the output currents Iro are generated in output side transistors of the current mirror circuit as analog currents or as additive current to or subtractive current from the current Ir according to the regulation data.

The regulation data of fine regulation for absorbing variation of individual products and obtaining the luminous intensities of R, G and B suitable to obtain white balance on a display screen is inputted to the products having the organic EL panel assembled with the column drivers 10 in a shipping test stage of the products. That is, the luminous intensity regulation data for R, G and B colors is inputted through a key board 13 to the MPU 11 and set in the 4-bit D/A converter circuit 2*b* through a register 7.

Similarly, in order to provide luminous intensities of the organic EL elements for obtaining white balance, the reference currents Iref outputted from the current mirror circuit 1*b* are roughly regulated to the design reference values, etc., in the reference current regulation circuits 2*a* of the reference current setting circuits 2G and 2B and further finely regulated by the D/A converter circuits 2*b* thereof. As a result, the reference current setting circuits 2G and 2B output the currents Igo and Ibo.

Incidentally, the fine regulation data of the luminous intensities of R, G and B colors with which white balance is obtained are stored in a non-volatile memory 12 provided in the MPU 11 and are set in the register 7 from the MPU 11 every time when a power source of the product is turned ON, so that a product such as an organic EL display device or a device having the same, which has a display screen capable of providing white balance, can be provided.

As described previously, the current mirror circuit 3R is the current duplication/distribution circuit for duplicating the output current Iro as the reference drive currents and distributing the reference drive currents to the respective terminal pins. The current mirror circuit 3R includes an input side transistor Tra and output side P channel MOSFET transistors Trb to Trn current-mirror connected to the input side transistor Tra. Sources of the P channel MOSFET transistors Trb to Trn are connected to a power source line +VDD(=+3V).

Drains of the transistors Trb to Trn are respectively connected to D/A converter circuits 4 each being constructed with a current mirror circuit. The output currents Iro from the drains of the transistors Trb to Trn are inputted to input side transistors of the D/A converter circuits 4 as reference drive currents or base currents. The D/A converter circuits 4 are current switching D/A converters, respectively, and generate analog currents by selectively switching the currents of the output side transistors according to the display data. Detailed constructions of the D/A converter and an output stage current source 5 are disclosed in U.S. patent application Ser. No. 10,360,715 (corresponding to JP 2003-308043A), which is hereby incorporated by reference.

Each D/A converter circuit 4 amplifies the reference drive current Iro according to the display data received from the MPU 11 through a display data register 6 provided for each terminal pin to generate a drive current corresponding to a luminous intensity every moment. The output stage current sources 5 are driven by such drive currents. Each output stage current source 5 is constructed with a current mirror circuit including a pair of transistors. According to the drive currents corresponding to the display data from the D/A converter circuits 4, the output stage current sources 5 output drive currents i to anodes of the organic EL display elements of the organic EL panel through output pins X1 to Xn on the column side. Incidentally, the output terminal pins X1 to Xn correspond to the terminal pins of the organic EL panel, respectively.

The D/A converter circuits 4 for G and B display colors receive the output currents Igo and Ibo as the reference drive currents, respectively, although not shown in FIG. 1.

In the case of the circuit construction for R color, channel width (gate width) ratio of the input transistor to the output transistor of the current mirror circuit 3R is 1:1. It should be noted that, by making the channel width area ratio K:1 (where K>1) to make the reference drive current value on the output side smaller than the drive current on the input side, it is possible to reduce noise. It is of course possible to make the output current value of the output side transistor lager than the input side current value Iro by making the channel width ratio 1:K.

In this embodiment, a switch circuit 8 is provided in parallel to the input side transistor Tra of the current mirror circuit 3R. The switch circuit 8 is constructed with a P channel MOSFET Trt. A source and a drain of the transistor Trt are connected to a source and a drain of the transistor Tra, respectively. The transistor Trt is ON/OFF controlled by 1-bit data supplied to a gate of the transistor Trt from a flag register 9.

The flag register 9 is a 3-bit register constructed with three flip-flops provided correspondingly to respective R, G and B display colors. The 1-bit data for R display color is sent to the switch circuit 8. The 1-bit data for G and B colors are sent to corresponding switch circuits 8 (not shown in FIG. 1), respectively.

Each bit of the 3-bit data to be set in the flag register 9 determines whether or not the organic EL elements belonging to one display line for each of R, G and B display colors are to be driven. If all of the organic EL elements of the one display color are not to be driven, the bit is set to "0" and otherwise to "1".

The 3-bit data set in the flag register 9 is produced by the MPU 11. The MPU 11 determines, for each display color, whether or not the display data for one display line, which is to be set in the display data register 6 provided for each terminal pin, is "0". This is determined when a total value of the display data for one display line, which is set in the display data register 6 of the color, is "0". The data "0" thus obtained is set in the flip-flop of the flag register 9 for each color. When the total value of the display data is not "0", "1" is set in the flip-flop.

When the flip-flop of the flag register 9 for R display color is set to "0", the gate of the transistor Trt becomes "L" (Low level) and is turned ON. Therefore, the output current Iro of the 4-bit D/A converter circuit 2*b* does not flow to the input side transistor Tra of the current mirror circuit 3R and so the transistor Tra is not driven and no output current generated at the drains of the transistors Trb to Trn. Thus, the D/A converter circuits 4 connected to the drains are not operated.

On the other hand, when "1" is set in the flip-flop for R color, the gate of the transistor Trt becomes "H" (High level) and the transistor Trt is turned OFF. Therefore, the output current Iro of the 4-bit D/A converter circuit 2*b* flows to the input side transistor Tra of the current mirror circuit 3R. Therefore, the D/A converter circuits 4 connected to the drains of the transistors Trb to Trn are driven by the output currents of the transistors Trb to Trn, respectively.

For G and B colors, the output side transistors of the current mirror circuits 3G and 3B are operated similarly according to the bits data "1" or "0" set in the corresponding flip-flops of the flag register 9.

As described, when "0" is set in the flip-flop of the flag register 9, the operation of the circuit portion from the corresponding current mirror circuit, which is a current duplication/distribution circuit, to the output stage current source 5 is stopped. As a result, power consumption of the organic EL display elements for one display line, which are not driven, is reduced.

In the above description, the transistor Trt of the switch circuit 8 is provided in parallel to the input side transistor Tra of the current mirror circuit 3R. However, it is possible to obtain a similar operation when the transistor Trt is provided in series with the input side transistor Tra of the current mirror circuit 3R.

For example, the transistor Trt may be provided between the drain of the transistor Tra and the output terminal of the reference current setting circuit 2R. Alternatively, the transistor Trt may be provided between the power source line +VDD and a terminal for connecting the sources of the transistors Tra to Trn commonly on the power supply side of the current mirror circuit 3R.

It is of course possible to stack the transistor Tra and the transistor Trt by connecting the drain of the transistor Tra to the source of the transistor Trt or connecting the source of the transistor Tra to the drain of the transistor Trt and to use the series transistor circuit as the input side transistor circuit of the current mirror circuit 3R. That is, the input side transistor of the current mirror circuit 3R includes the two transistors. In such case, in order to balance the output side of the current mirror circuit 3R with respect to the input side thereof, it is preferable to insert resister circuits, etc., in series with the output side transistors Trb to Trn.

In the case where the switch circuit is provided in series with the input side transistor of the current mirror circuit 3R, the ON/OFF control of the transistor Trt is contrary to the case shown in FIG. 1 in which the transistor Trt is connected in parallel to the input side transistor Tra. Therefore, the 3-bit data set in the flag register 9 is outputted to the gate of the transistor Trt through an inverter or is set in the flag register 9 after the bit data is inverted.

Figure 2:
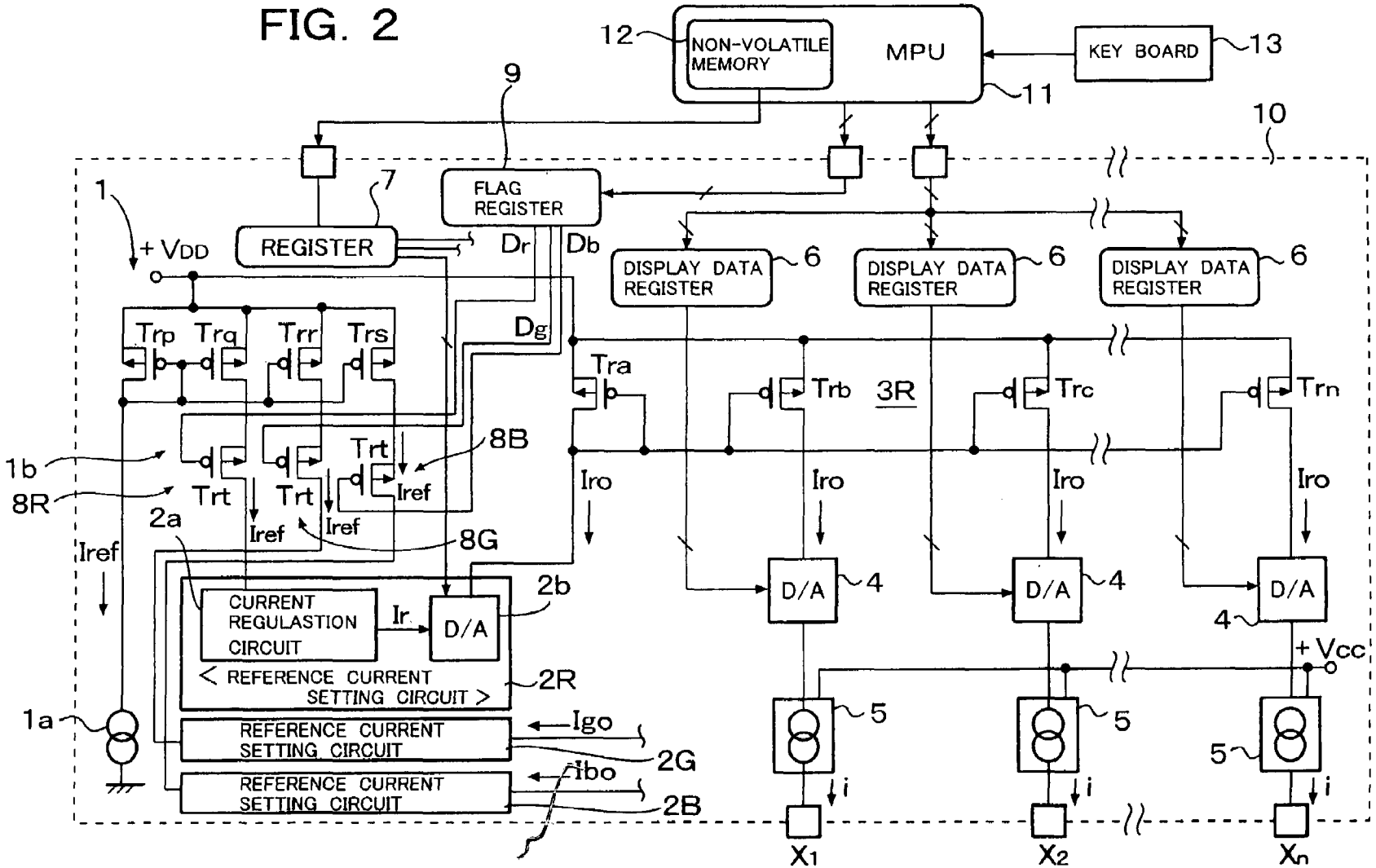
FIG. 2 is a block circuit diagram of a column driver of an organic EL panel including an organic EL element drive circuit according to another embodiment of the present invention.

FIG. 2 is a block circuit diagram of an organic EL display panel including an organic EL element drive circuit according to another embodiment of the present invention.

The embodiment shown in FIG. 2 is featured by that a switch circuit is provided between the drive stage of the column driver 10 and the input stage of the current mirror circuit 3R. In detail, switch circuits 8R, 8G and 8B, which correspond to the switch 8 shown in FIG. 1, are connected to the respective transistors Trq, Trr and Trs of the current mirror circuit 1*b* of the reference current generator circuit 1.

The switch circuit 8R is provided between the drain of the transistor Trq and the current regulator circuit 2*a* of the reference current setting circuit 2R. Similarly, the switch circuit 8G is provided between the drain of the transistor Trr and the current regulator circuit 2*a* of the reference current setting circuit 2G and the switch circuit 8B is provided between the drain of the transistor Trs and the current regulator circuit 2*a* of the reference current setting circuit 2B.

Each of the switch circuits 8R, 8G and 8B is constructed with a transistor Trt similarly to the switch circuit 8 shown in FIG. 1 and is ON/OFF controlled according to the bit data Dr, Dg and Db from the flag register 9 to block the reference current Iref to thereby block the drive current for driving the input transistor Tra of the current mirror circuit 3R.

Each bit of the 3-bit control data set in the flag register 9 determines whether or not the organic EL elements belonging to one display line for each of R, G and B display colors are to be driven. If all of the organic EL elements of the one display color connected to the output terminal pins X1 to Xn are not to be driven, the bit is set to "1" and otherwise to "0".

This control is the same as in the case where the switch circuit 8 is connected in series to the input transistor Tra of the current mirror circuit 3R.

In the embodiment shown in FIG. 2, it may be possible to provide the transistor Trt of the switch circuit 8 shown in FIG. 1 in parallel with the input side transistor Trp of the current mirror circuit 1*b* instead of the switch circuits 8R, 8G and 8B. In such case, the 1-bit control data for controlling the switch circuit becomes similar to that in the case shown in FIG. 1.

In such case, the switch circuit 8 is ON/OFF controlled by the 1-bit data and, when the switch circuit 8 is turned ON, the transistors Trq, Trr and Trs are turned OFF simultaneously.

In the embodiments shown in FIG. 1 and FIG. 2, it is necessary, prior to the setting of the display data in the display data register, to determine whether or not the display data indicate that the organic EL display elements for one display line are to be not driven. However, such prior determination becomes unnecessary by logically processing the data already set in the display data register by means of a logic circuit.

Figure 3:
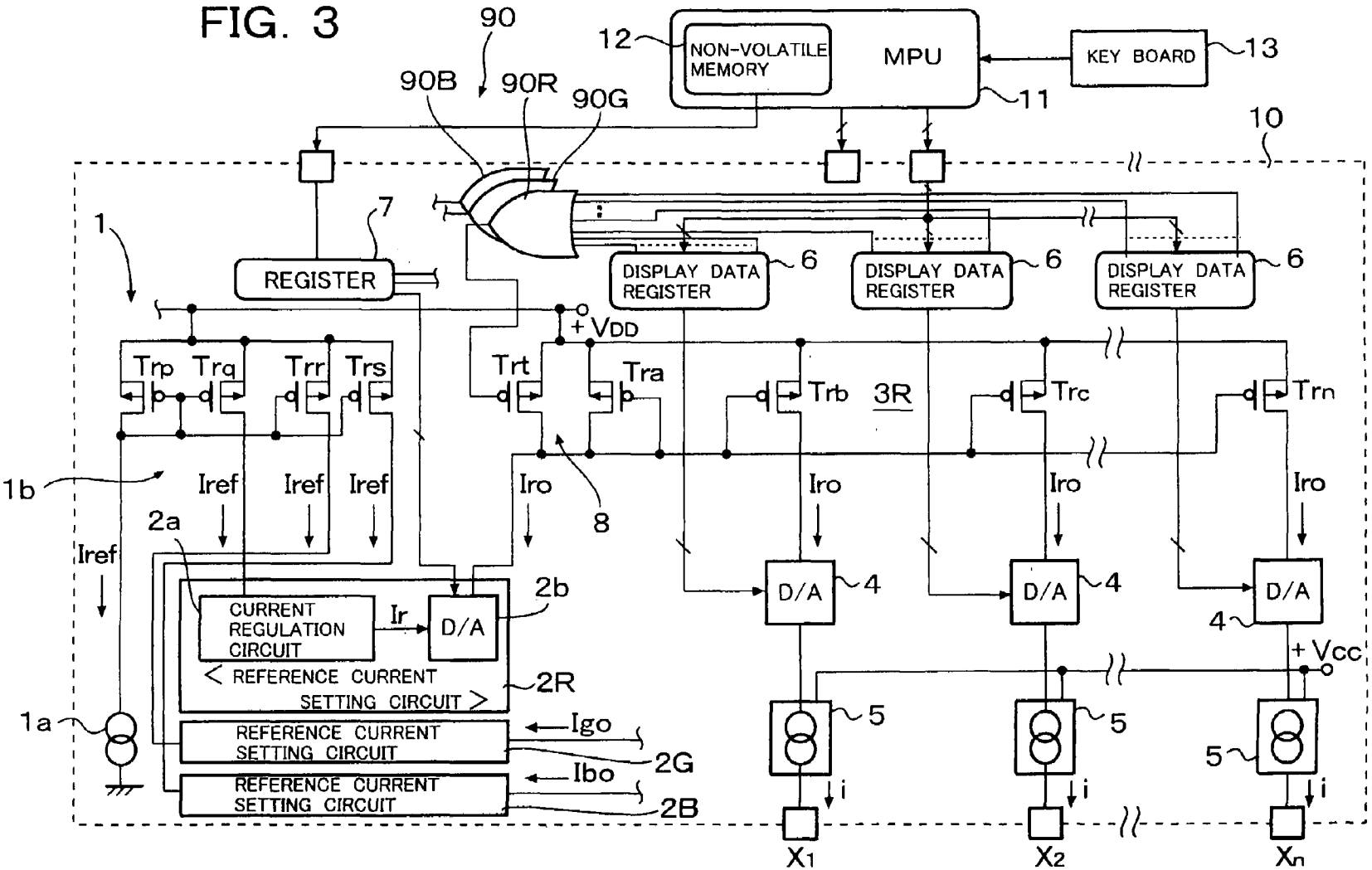
FIG. 3 is a block circuit diagram of a column driver of an organic EL panel including an organic EL element drive circuit according to a further embodiment of the present invention.

FIG. 3 shows a logic circuit for realizing this method. As described previously, the total value of the display data for one display line with which the organic EL elements are not driven is "0". In such case, all bits of the display data become "0". In order to realize such situation, an OR circuit 90 is provided instead of the flag register as a control circuit, as shown in FIG. 3.

The OR circuit 90 is composed of OR circuits 90R, 90G and 90B corresponding to R, G and B display colors, respectively. Describing the OR circuit 90R, digit outputs of the display register 6 for one R color display line are inputted to the OR circuit 90R. Since the OR circuits 90G and 90B are similar to the OR circuit 90R, details thereof are not shown in FIG. 3.

In FIG. 3, it should be noted that the single line connecting the display register 6 to the associated D/A converter circuit 4 corresponds to the lines connecting the display register 6 to the OR circuit 90R.

In this embodiment, all bits for one display line for each of R, G and B colors are ORed by each of the OR circuits 90R, 90G and 90B and the transistors Trt are ON/OFF controlled without necessity of the flag register 9 by supplying the ORed bits to the gates of the transistors Trt.

Figure 4:
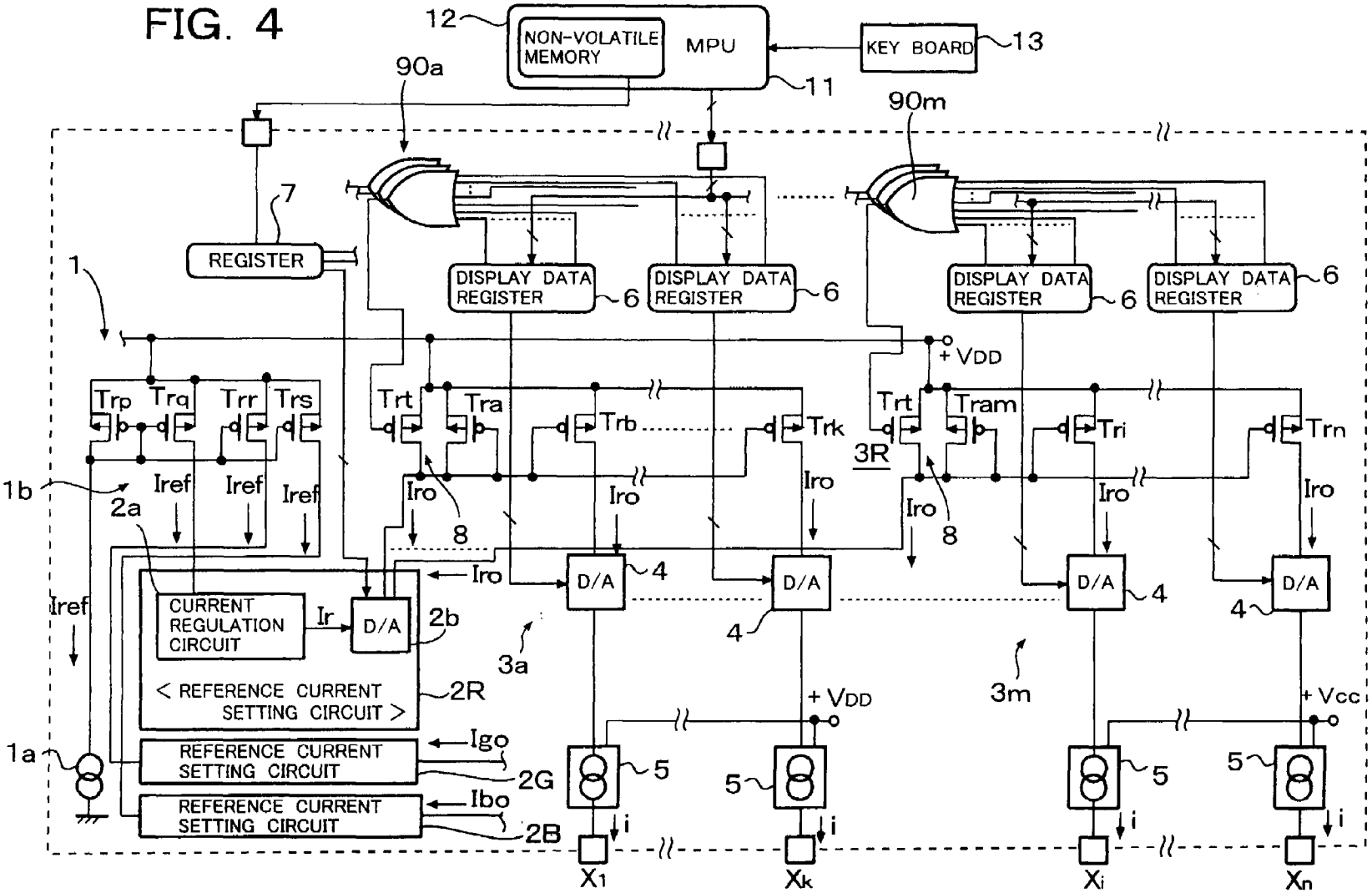
FIG. 4 is a block circuit diagram of a column driver of an organic EL panel including an organic EL element drive circuit according to another embodiment of the present invention.

FIG. 4 shows another embodiment of the present invention in which each of the current mirror circuits 3R, 3G and 3B is divided to a plurality (m) of current mirror circuit portions 3*a* to 3*m*, a switch circuit 8 is provided in parallel with the input side transistor Tra of each of the current mirror circuit portions 3*a* to 3*m* and the drive currents for driving the input transistor Tra corresponding to each of the current mirror circuit portions 3*a* to 3*m* are ON/OFF controlled by ON/OFF control of the switch circuit 8. By using this circuit construction, it is possible to block the reference drive currents or a base current inputted to input side transistors of the D/A converter circuits 4 by cutting a drive current for driving the input transistor Tra of any of the current mirror portions 3*a* to 3*m* for a part of one horizontal display line.

The plurality (m) of current mirror circuit portions 3*a* to 3*m* may be assigned to a plurality (m) of the column IC drivers, respectively. Two or more of the plurality of current mirror circuit portions 3*a* to 3*m* may be assigned to one of a plurality of the column IC drivers.

In this case, it is possible to block the reference drive current inputted to input side transistors of the D/A converter circuits 4 of each of the column IC drivers for a part of one display line.

The current mirror circuit portion 3*a* includes an input side transistor Tra to which a switch circuit 8 (transistor Trt) connected in parallel and a plurality of output side transistors Trb to Trk. An OR circuit 90*a* is provided for the current mirror circuit portion 3*a*.

The current mirror circuit portion 3*m* includes an input side transistor Tran to which a switch circuit 8 (transistor Trt) connected in parallel and a plurality of output side transistors Tri to Trn. An OR circuit 90*m* is provided for the current mirror circuit portion 3*m*. Circuit constructions of other current mirror circuit portions are similar to that of the current mirror circuit portion 3*a*.

The switch circuits 8 are ON/OFF controlled by the outputs of the respective OR circuits 90*a* to 90*m*. OR circuits 90*a* to 90*m* are provided for the current mirror circuit portions 3*a* to 3*m* of each of the current mirror circuits 3G and 3B.

By providing a switch circuit 8 for each of the current mirror circuit portions 3*a* to 3*m*, it becomes possible to block the reference drive current for a part of one display line at current mirror circuit units.

Instead of the OR circuits 90*a* to 90*m*, it is possible to control the switch circuits 8 by means of the flag register 9 shown in FIG. 1 by assigning memory areas of the flag register 9 to the respective current mirror circuit portions 3*a* to 3*m*. In such case, the MPU 11 determines whether or not all of the display data for each current mirror circuit portion are not to be actuated and sets bit data corresponding to the determination in the flag register 9. In the latter case, an amount of the bit data set in the flag register 9 is increased correspondingly to the number of the current mirror circuit portions.

In the above mentioned case, the switch circuits 8 may be provided in the power source lines of the current mirror circuit portions or the power source lines of the output side transistors of the current mirror circuit portions, respectively. In such case, the power source lines provided correspondingly to the current mirror circuit portions 3*a* to 3*m* are ON/OFF controlled.

Incidentally, the flag register used in each of the described embodiments may be an ordinary memory. Similarly, the display data register 6 may be an ordinary memory.

In the described embodiments, the display data, the luminous intensity regulation data and the flag data are set by the MPU 11. However, any one of these data or all of the data may be outputted from a controller.

Further, the reference current setting circuit 2R includes the current regulation circuit 2*a* and the D/A converter circuit 2*b* and the reference current setting circuits 2G and 2B are constructed similarly, so that white balance can be regulated. However, such reference current setting circuits are not always necessary in the present invention. In a case where there is no such reference current setting circuits, the current duplication/distribution circuits, that is, the current mirror circuits 3R, 3G and 3B may be directly driven by the reference current Iref from the reference current generator circuit.

Although the color display is described in the embodiments, the present invention can be applied to a monochromatic display device. Further, the present invention can be applied to the passive matrix type organic EL panel or the active matrix type organic EL panel.

What is claimed is:

1. An organic EL panel drive circuit for current-driving organic EL display elements through terminal pins thereof, comprising:

a first current mirror circuit including an input side transistor and a plurality of output side transistors provided correspondingly to said terminal pins, said first current mirror circuit responsive to a predetermined current supplied to said input side transistor for generating drive currents supplied to said terminal pins or base currents from which the drive currents supplied to said terminal pins are generated;

a switch circuit provided in parallel with or in series with said input side transistor;

memory means for storing a display data indicative of display luminous intensity of said organic EL elements driven by the currents through said terminal pins; and a control circuit for ON/OFF controlling said switch circuit to prevent said input side transistor from being driven by the predetermined current when the display data for one display line or for a part of the one display line corresponding to a horizontal scan direction stored in said memory means or a display data for one display line or for the part of the one display line to be stored in said memory means indicates that said organic EL elements are not to be driven by the drive currents.

2. The organic EL panel drive circuit as claimed in claim 1, further comprising a flag register, wherein said memory means includes a plurality of registers provided correspondingly to said terminal pins, said switch circuit is ON/OFF controlled according to a value of at least 1-bit data stored in said flag register and said control circuit performs an ON/OFF control said switch circuit by setting the 1-bit data in said flag register.

3. The organic EL panel drive circuit as claimed in claim 1, wherein said memory means includes a plurality of registers provided correspondingly to said terminal pins, said control circuit is an OR circuit for ORing the all bits stored in said respective registers and said switch circuit is ON/OFF controlled according to an output of said OR circuit.

4. The organic EL drive circuit as claimed in claim 1, further comprising a plurality of D/A converter circuits provided correspondingly to said terminal pins, wherein each said D/A converter circuit is constructed with a second current mirror circuit, said D/A converter circuits receive the base currents from said output side transistors of said first current mirror circuit and the display data and generate the drive currents supplied to said terminal pins or currents for driving an output stage of said organic EL drive circuit as analog currents according to the display data, respectively.

5. The organic EL panel drive circuit as claimed in claim 4, further comprising a plurality of output stage current sources provided correspondingly to said terminal pins provided in said output stage, wherein said switch circuit is a MOS transistor and outputs of said output stage current sources are supplied to said terminal pins.

6. The organic EL panel drive circuit as claimed in claim 1, wherein said memory means includes a plurality of registers provided correspondingly to said terminal pins, said first current mirror circuit, said switch circuit and said registers are provided correspondingly to R, G and B display colors and said control circuit turns any of said switch circuits for R, G and B display colors corresponding to one display line of one of R, G and B display colors or for a part of said one display line ON or OFF when a display data for the one display line or for the part of the one display line indicates that said organic EL display elements corresponding to said display line or said part are not to be driven.

7. The organic EL panel drive circuit as claimed in claim 1, wherein said first current mirror circuit includes a plurality of current mirror circuit portions and said switch circuit is provided correspondingly to an input side transistor of each of said current mirror circuit portions.

8. The organic EL panel drive circuit as claimed in claim 7, wherein said control circuit turns said switch circuit ON or OFF to prevent said input side transistor from being driven by the predetermined current when the display data stored in all of said registers corresponding to a certain one of said current mirror circuit portions or display data to be stored in all of said registers indicates that said organic EL elements are not to be driven by the drive currents.

9. The organic EL panel drive circuit as claimed in claim 1, further comprising a constant current source for generating a reference current, wherein said switch circuit is provided between said constant current source and said input side transistor, and said predetermined current is generated by the reference current.

10. The organic EL panel drive circuit as claimed in claim 1, wherein said first current mirror circuit including a plurality of current mirror circuit portions having the input side transistor and the plurality of output side transistors, the plurality of current mirror circuit portions assigned to a plurality of the column IC drivers and said switch circuit is provided in parallel with or in series with the input side transistor of each of the current mirror circuit portions.

11. An organic EL element drive circuit for current-driving organic EL display elements through terminal pins of an organic EL panel, comprising:

a reference current generator circuit for generating a reference current;

a current mirror circuit including an input side transistor and a plurality of output side transistors provided correspondingly to said terminal pins, said current mirror circuit responsive to the reference current supplied directly to or a current having a regulated value supplied to said input side transistor, for generating drive currents supplied to said terminal pins or base currents from which the drive currents supplied to said terminal pins are generated;

a switch circuit provided between said reference current generator circuit and said input side transistor of said current mirror circuit;

memory means for storing a display data indicative of display luminous intensity of said organic EL elements driven by the currents through said terminal pins; and a control circuit for turning said switch circuit ON or OFF to prevent said input side transistor from being driven by one of the reference current or the current having a regulated value when the display data for one display line or for a part of the one display line corresponding to a horizontal scan direction stored in said memory means or a display data for one display line or for the part of the one display line to be stored in said memory means indicates that said organic EL elements are not to be driven by the drive currents.

12. The organic EL panel drive circuit as claimed in claim 11, further comprising a distributor circuit for distributing the reference current correspondingly to R, G and B display colors and current regulator circuits provided correspondingly to R, G and B colors for regulating the current values distributed by said distributor circuit, wherein said memory means includes a plurality of registers, said current mirror circuit, said switch circuit and said registers are provided correspondingly to the respective R, G and B colors and said control circuit performs an ON/OFF control of said switch circuit correspondingly to R, G and B display colors.

13. The organic EL panel drive circuit as claimed in claim 12, wherein said current mirror circuit corresponding to each of R, G and B colors includes a plurality of current mirror circuit portions and said switch circuit is provided correspondingly to the input side transistor of each current mirror circuit portion.

14. The organic EL panel drive circuit as claimed in claim 13, wherein said switch circuits corresponding to R, G and B display colors are provided between said reference current generator circuit and said input side transistors corresponding to R, G and B display colors.

15. The organic EL panel drive circuit as claimed in claim 11, wherein said current mirror circuit including a plurality of current mirror circuit portions having the input side transistor and the plurality of output side transistors, the plurality of current mirror circuit portions assigned to a plurality of the column IC drivers and said switch circuit is provided in parallel with or in series with the input side transistor of each of the current mirror circuit portions.

16. An organic EL display device having an organic EL drive circuit for current-driving organic EL elements through terminal pins of an organic EL panel, comprising:

an organic EL display panel driven by said organic EL drive circuit;

a reference current generator circuit for generating a reference current;

a current mirror circuit including an input side ransistor and a plurality of output side transistors provided correspondingly to said terminal pins, said current mirror circuit responsive to the reference current supplied directly to or a current having a regulated value supplied to said input side transistor, for generating drive currents supplied to said terminal pins or base currents from which the drive currents supplied to said terminal pins are generated;

a switch circuit provided in parallel to or in series with said input side transistor;

memory means for storing a display data indicative of display luminous intensity of said organic EL elements driven by the currents through said terminal pins; and a control circuit for turning said switch circuit ON or OFF to prevent said input side transistor from being driven by one of the reference current and the current having a regulated value when the display data for one display line or for a part of the one display line corresponding to a horizontal scan direction stored in said memory means or a display data for one display line or for the part of the one display line to be stored in said memory means indicates that said organic EL elements are not to be driven by the drive currents.

17. The organic EL panel display device as claimed in claim 16, further comprising a flag memory, wherein said memory means includes a plurality of registers provided correspondingly to said terminal pins, said switch circuit is turned ON or OFF according to a value of at least 1-bit data stored in said flag register and said control circuit performs an ON/OFF control of said switch circuit by setting the 1-bit data in said flag memory.

18. The organic EL display device as claimed in claim 16, wherein said memory means includes a plurality of registers provided correspondingly to said terminal pins, said control circuit is an OR circuit for ORing the all bits stored in said respective registers and said switch circuit is ON/OFF controlled according to an output of said OR circuit.

* * * * *